United States Patent [19]

Masterton

[11] Patent Number: 4,583,022

[45] Date of Patent: Apr. 15, 1986

[54] COLOR PICTURE TUBE HAVING SHADOW MASK WITH SPECIFIC CURVATURE AND COLUMN APERTURE SPACING

[75] Inventor: Walter D. Masterton, Manheim Township, Lancaster County, Pa.

[73] Assignee: RCA Corporation, Princeton, N.J.

[21] Appl. No.: 615,589

[22] Filed: May 31, 1984

[51] Int. Cl.[4] ..... H01J 29/07

[52] U.S. Cl. ..... 313/403; 313/402; 313/408

[58] Field of Search ..... 313/402, 403, 408

[56] References Cited

U.S. PATENT DOCUMENTS

| | | | |
|---|---|---|---|
| 3,590,303 | 6/1971 | Coleclough | 313/402 |
| 3,633,058 | 1/1972 | Kouno | 313/92 B |
| 3,931,906 | 1/1976 | Bradu | 425/505 |
| 3,947,718 | 3/1976 | van Lent | 313/408 |
| 4,136,300 | 1/1979 | Morrell | 313/403 |

OTHER PUBLICATIONS

U.S. patent application Ser. No. 469,772, entitled, "Cathode-Ray Tube Having an Improved Shadow Mask Contour", filed on Feb. 25, 1983 by F. R. Ragland, Jr. (RCA 79,242A).

U.S. patent application Ser. No. 469,774, entitled, "Cathode-Ray Tube Having a Faceplate Panel with a Substantially Planar Periphery", filed on Feb. 25, 1983, by F. R. Ragland, Jr. (RCA 79,242).

U.S. patent application Ser. No. 469,775, entitled, "Cathode-Ray Tube Having Different Curvatures along Major and Minor Axes", filed on Feb. 25, 1983, by R. J. D'Amato et al. (RCA 79,235).

U.S. patent application Ser. No. 529,644, entitled, "Cathode-Ray Tube Having a Faceplate Panel with an Essentially Planar Screen Periphery", filed on Sep. 6, 1983 by R. J. D'Amato et al. (RCA 80,184).

*Primary Examiner*—Palmer C. DeMeo
*Assistant Examiner*—Michael Razavi
*Attorney, Agent, or Firm*—Eugene M. Whitacre; Dennis H. Irlbeck

[57] ABSTRACT

An improvement is made in a color picture tube having a slit-type shadow mounted therein in spaced relation to a cathodoluminescent line screen. For the mask, the spacing between adjacent aperture columns increases from center-to-edge as approximately the fourth power of the distance along from the center. Such fourth order spacing variation permits shaping of the shadow mask so that the contour of the mask along its major axis also varies as a function substantially of the fourth power of distance along from the center of the mask.

4 Claims, 8 Drawing Figures

COLOR PICTURE TUBE HAVING SHADOW MASK WITH SPECIFIC CURVATURE AND COLUMN APERTURE SPACING

This invention relates to color picture tubes of the type having a slit-aperture type apertured shadow mask mounted in close relation to a cathodoluminescent line screen of the tube and, particularly, to an improvement in mask aperture column spacing within such tubes.

Most color picture tubes presently being manufactured are of the line screen-slit mask type. These tubes have spherically contoured faceplates with line screens of cathodoluminescent materials thereon, and somewhat spherically contoured slit-apertured shadow masks adjacent to the screens. The slit-shaped apertures in such tubes are arranged in columns that substantially parallel the minor axis of the tube.

Recently, several color picture tube modifications have been suggested. One of these modifications is a new faceplate panel contour concept which creates the illusion of flatness. Such tube modification is disclosed in four recently-filed, copending U.S. applications: Ser. No. 469,772, filed by F. R. Ragland, Jr. on Feb. 25, 1983; Ser. No. 469,774, filed by F. R. Ragland, Jr. on Feb. 25, 1983; Ser. No. 469,775, filed by R. J. D'Amato et al. on Feb. 25, 1983; and Ser. No. 529,644, filed by R. J. D'Amato et al. on Sept. 6, 1983. The faceplate contour of the modified tube has curvature along both the major and minor axes of the faceplate panel, but is nonspherical. In a preferred embodiment described in these applications, the peripheral border of the tube screen is planar or at least visually appears to be substantially planar. In order to obtain this planar or substantially planar peripheral border, it is necessary to form the faceplate panel with a curvature along its major axis that is greater at the sides of the panel than at the center of the panel. Such nonspherical shaping of the faceplate panel creates a problem involving shadow mask shape and aperture column-to-column spacing in the shadow mask.

In the first line screen-slit mask type tubes, the shadow masks were almost spherical and the separation of the adjacent aperture columns along the major axis (horizontal separation) was held constant over the mask. However, some later tubes of this type included a shadow mask with increased curvature and incorporated an aperture column spacing variation taught in U.S. Pat. No. 4,136,300, issued to A. M. Morrell on Jan. 23, 1979. In such later tubes, the spacing between centerlines of adjacent columns of apertures increased from center-to-edge of the mask. This increase varied along the major axis generally as the square of the distance from the minor axis. If the column-to-column spacing in the newer substantially planar tubes were permitted to vary as the square of the distance from the minor axis, the curvature of the mask would have to be decreased to obtain acceptable location or packing of the screen lines. It should be noted that the screen is formed by a photographic process that uses the shadow mask as a photo master. However, reducing the curvature of the shadow mask reduces its stiffness and increases distortions of the mask during tube operation. Therefore, the shadow mask for the new substantially planar tubes have contours similar to the faceplate contours. Such mask contours are generally described in aforementioned copending application Ser. No. 469,772. However, the copending application does not provide a specific equation for mask contour and does not teach a specific aperture column-to-column spacing variation for such mask. In any event, the prior column-to-column spacing variations are unsuitable for these newer mask contours. Therefore, there is a need for a new aperture column-to-column spacing for use in the shadow masks of such newer tubes.

SUMMARY OF THE INVENTION

An improvement is made in a color picture tube having a slit-aperture type shadow mask mounted therein in spaced relation to a cathodoluminescent line screen. In the specific improvement, the spacing between adjacent aperture columns increases from center-to-edge of the shadow mask as approximately the fourth power of the distance from the center of the mask.

Such fourth order spacing variation permits shaping of the shadow mask so that the contour of the mask along its major axis also varies as a function of the fourth power of distance from the center of the mask.

DETAILED DESCRIPTION OF THE PREFERRED EMBODIMENTS

Figure 1:
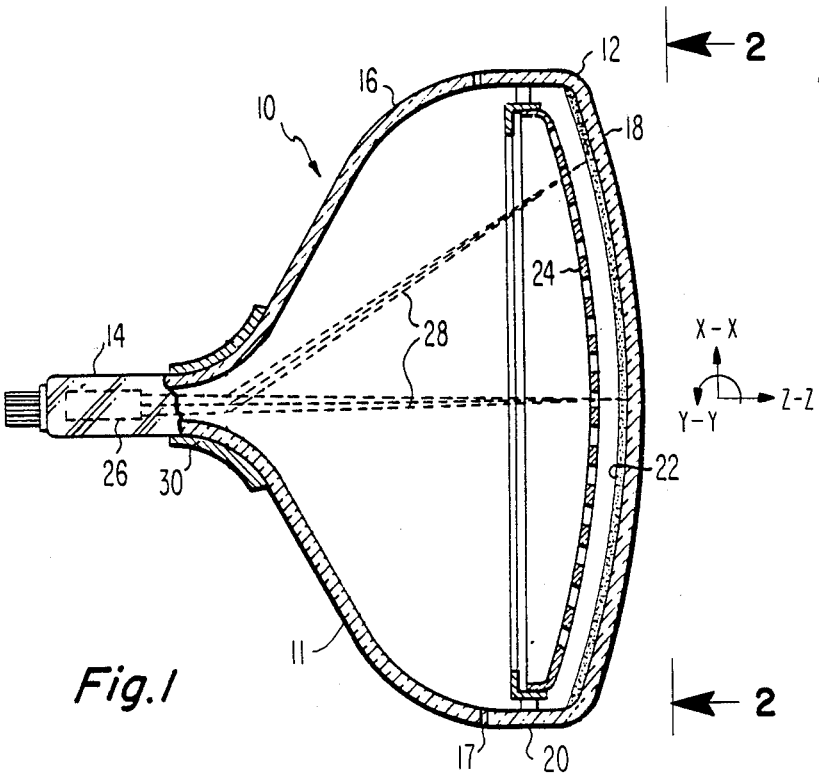
FIG. 1 is a plan view, partly in axial section, of a shadow mask color picture tube incorporating one embodiment of the present invention.

FIG. 1 shows a rectangular cathode-ray tube in the form of a color picture tube 10 having a glass envelope 11, comprising a rectangular faceplate panel 12 and a tubular neck 14 connected by a funnel 16. The panel comprises a viewing faceplate 18 and a peripheral flange or sidewall 20, which is sealed to the funnel 16 by a glass frit 17. A rectangular three-color cathodoluminescent phosphor screen 22 is carried by the inner surface of the faceplate 18. The screen is preferably a line screen, with the phosphor lines extending substantially parallel to the minor axis, Y—Y, of the tube (normal to the plane of FIG. 1). A novel multi-apertured color selection electrode or shadow mask 24 is removably mounted within the faceplate panel 12 in predetermined spacing relation to the screen 22. An inline electron gun 26, shown schematically by dashed lines in FIG. 1, is centrally mounted within the neck 14 to generate and direct three electron beams 28 along initially coplanar convergent paths through the mask 24 to the screen 22.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally in the direction of the major axis (X—X) and vertically in the direction of the minor axis (Y—Y), respectively, in a rectangular raster over the screen 22.

Figure 2:
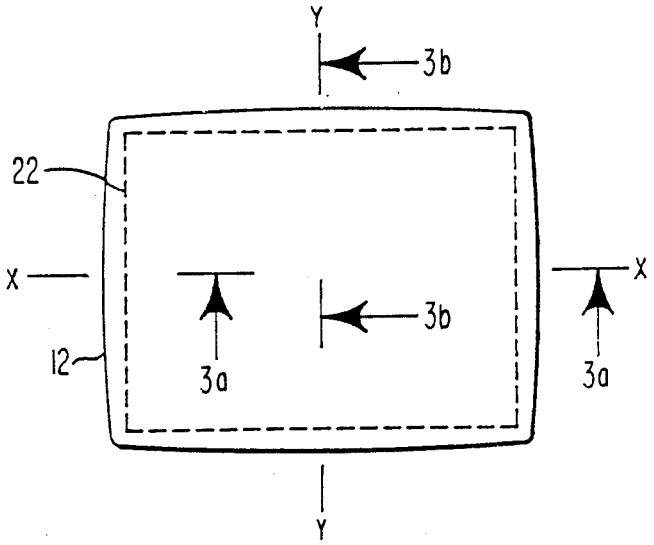
FIG. 2 is a front view of the faceplate of the color picture tube taken at line 2—2 of FIG. 1.

FIG. 2 shows the front of the faceplate panel 12. The periphery of the panel 12 forms a rectangle with slightly curved sides. The border of the screen 22 is shown with dashed lines in FIG. 2. This screen border is rectangular.

Figure 3:
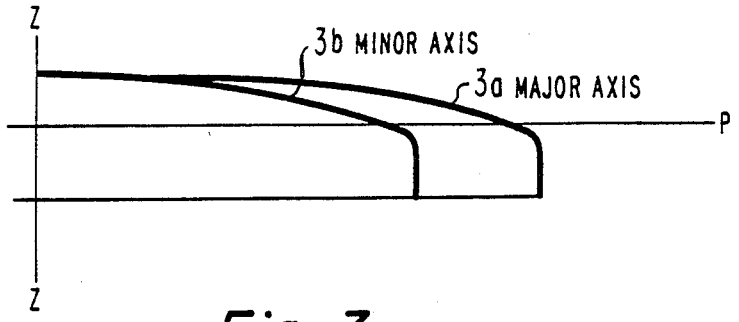
FIG. 3 is a compound view showing the surface contours of the faceplate panel at the major axis, *3a*—*3a*, and the minor axis, *3b*—*3b*, cross-sections of FIG. 2.

A comparison of the relative contours of the exterior surface of the faceplate panel 12 along the minor axis, Y—Y, and major axis, X—X, is shown in FIG. 3. The exterior surface of the faceplate panel 12 is curved along both the major and minor axes, with the curvature along the minor axis being greater than the curvature along the major axis in the center portion of the panel 12. For example, at the center of the faceplate, the ratio of the radius of curvature of the exterior surface contour along the major axis to the radius of curvature along the minor axis is greater than 1.1 (i.e., a greater than 10% difference). The curvature along the major axis, however, is much less in the central portion of the faceplate and increases near the edges of the faceplate. In this one embodiment, the curvature along the major axis, near the edges of the faceplate, is greater than the general curvature along the minor axis. With this design, the central portion of the faceplate becomes flatter, while the points of the faceplate exterior surface at the edges of the screen lie substantially in a plane P and define a substantially rectangular peripheral contour line. The surface curvature along the diagonal is selected to smooth the transition between the different curvatures along the major and minor axes. In a preferred embodiment, the curvature along the minor axis is at about 4/3 greater than the curvature along the major axis in the central portion of the faceplate.

By using the differing curvatures along the major and minor axes, the points on the exterior surface of the panel, directly opposite the edges of the screen 22, lie substantially in the same plane P. These substantially planar points, when viewed from the front of the faceplate panel 12, as in FIG. 2, form a contour line on the exterior surface of the panel that is substantially a rectangle superposed on the edges of the screen 22. Therefore, when the tube 10 is inserted into a television receiver, a uniform width border mask or bezel can be used around the tube. The edge of such a bezel that contacts the tube at the rectangular contour line also is substantially in the plane P. Since the periphery border of a picture on the tube screen appears to be planar, there is an illusion created that the picture is flat, even though the faceplate panel is curved outwardly along both the major and minor axes.

Figure 4:
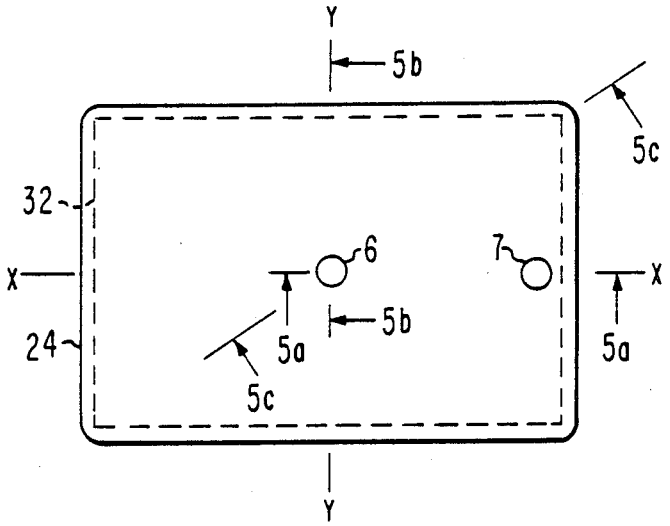
FIG. 4 is a front view of the shadow mask of the color picture tube of FIG. 1.
Figure 5:
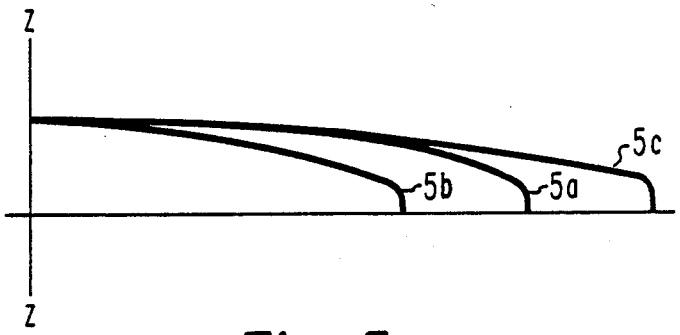
FIG. 5 is a compound view showing the surface contours of the shadow mask at the major axis, *5a*—*5a*, the minor axis, *5b*—*5b*, and the diagonal, *5c*—*5c*, cross-sections of FIG. 4.

FIG. 4 shows a front view of the novel shadow mask 24. The dashed lines 32 show the border of the apertured portion of the mask 24. The surface contours along the major axis, X—X, the minor axis, Y—Y, and the diagonal of the mask 24 are shown by the curves 5*a*, 5*b* and 5*c*, respectively, in FIG. 5. The mask 24 has a different curvature along its major axis than along its minor axis. The contour along the major axis has a slight curvature near the center of the mask and greater curvature at the sides of the mask. The contour of such a shadow mask can be generally obtained by describing the major axis, X—X, curvature as a large radius circle over about the central portion of the major axis, and a smaller radius circle over the remainder of the major axis. However, more specifically, the sagital height along the major axis varies substantially as the fourth power of distance from the minor axis, Y—Y. Sagital height is the distance from an imaginary plane that touches and is tangent to the center of the surface of the mask. The curvature parallel to the minor axis, Y—Y, is such as to smoothly fit the major axis curvature to the required mask periphery and can include a curvature variation as is used along the major axis. Such mask contour exhibits some improved thermal expansion characteristics because of the increased curvature near the ends of the major axis. The relation of improved thermal expansion characteristics from increased curvature is discussed in aforementioned U.S. Pat. No. 4,136,300.

Table I presents the fourth order curvature of the novel shadow mask along its major axis, X—X, for a tube having a 27 inch (68.58 cm) diagonal viewing screen. The first column of Table I represents distance from the minor axis, Y—Y. The second column is the distance from the minor axis taken to the fourth power. The third column represents fourth power calculations for Z-axis or sagital heights. Such calculations are based on the equation, Sagital height $=0.1314\times^4$.

TABLE I

| (Inches) X | (Inches)$^4$ $X^4$ | (Mils) $0.1314X^4$ |
|---|---|---|
| 0 | 0 | 0 |
| 1 | 1 | 0 |
| 2 | 16 | 2 |
| 3 | 81 | 10 |
| 4 | 256 | 33 |
| 5 | 625 | 82 |
| 6 | 1296 | 170 |
| 7 | 2401 | 315 |
| 8 | 4096 | 538 |
| 9 | 6561 | 862 |
| 9.5 | 8145 | 1070 |

Figure 6:
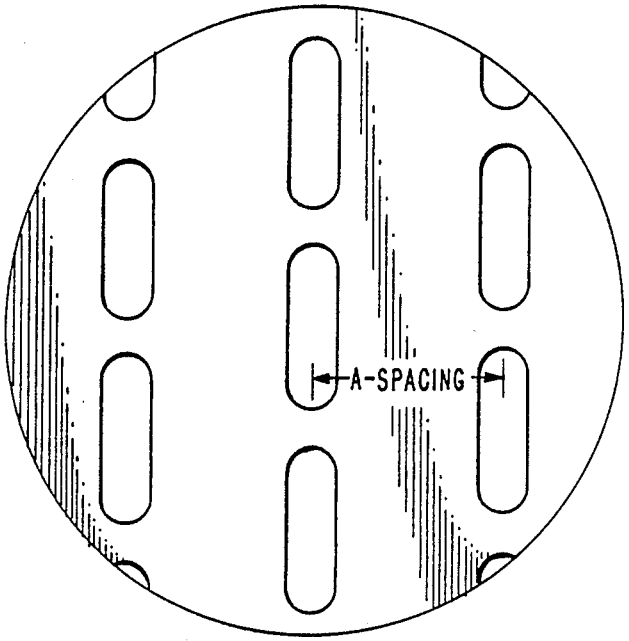
FIGS. 6 and 7 are enlarged views of the shadow mask taken at circles 6 and 7, respectively, of FIG. 4.
Figure 7:
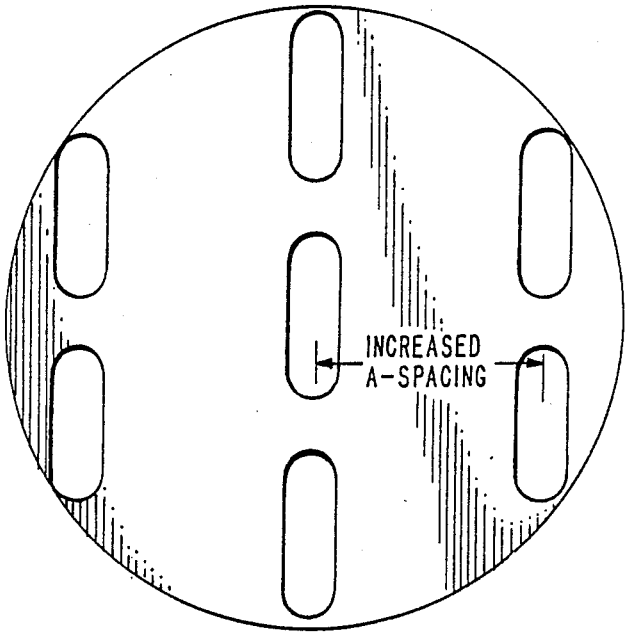

Because of the novel approximately fourth order contour, the spacing variations between aperture columns that were used in prior shadow masks are inappropriate for the novel shadow mask. Generally, the a-spacing, that is, the spacing between the centerlines of adjacent aperture columns, increases from center-to-edge in the novel mask as does the a-spacing in the prior masks. Such increase in a-spacing can be seen by comparing FIG. 6, representing the center of the mask, with FIG. 7, representing the edge of the mask. However, in the novel mask, the variation in a-spacing differs in a substantial and important manner from such variations in prior masks.

The horizontal a-spacing between aperture columns in the novel shadow mask 24 varies approximately as a function of the fourth power of distance from the center or Y-axis of the tube. This fourth order a-spacing variation is presented in Table II for a color picture tube having a 27 inch (68.58 cm) diagonal viewing screen. In Table II, the first column represents distance from the minor axis, Y—Y, measured along the major axis, X—X. The second column rpresents the distance in the first column taken to the fourth power. The third column rpresents a calculated a-spacing based upon a function of the fourth power of distance.

TABLE II

| (Inches) X | (Inches)$^4$ $X^4$ | (Mils) $30 + .001X^4$ |
|---|---|---|
| 0 | 0 | 30.0 |
| 1 | 1 | 30.0 |
| 2 | 16 | 30.0 |
| 3 | 81 | 30.1 |
| 4 | 256 | 30.3 |
| 5 | 625 | 30.6 |
| 6 | 1296 | 31.3 |
| 7 | 2401 | 32.4 |
| 8 | 4096 | 34.1 |
| 9 | 6561 | 36.6 |
| 9.67 | 8744 | 38.7 |

Comparable data for a conventional substantially spherical contour shadow mask of similar size is presented in Table III. In this table, the first column represents the distance along the major axis from the minor axis. The second column represents the square of the distance from the minor axis. The third column represents a calculated a-spacing based upon a function of the second power of distance.

TABLE III

| (Inches) X | (Inches)$^2$ $X^2$ | (Mils) $30 + .097X^2$ |
|---|---|---|
| 0 | 0 | 30.0 |
| 1 | 1 | 30.1 |
| 2 | 4 | 30.4 |
| 3 | 9 | 30.9 |
| 4 | 16 | 31.6 |
| 5 | 25 | 32.4 |
| 6 | 36 | 33.5 |
| 7 | 49 | 34.8 |
| 8 | 64 | 36.2 |
| 9 | 81 | 37.9 |
| 9.60 | 92.2 | 38.9 |

Figure 8:
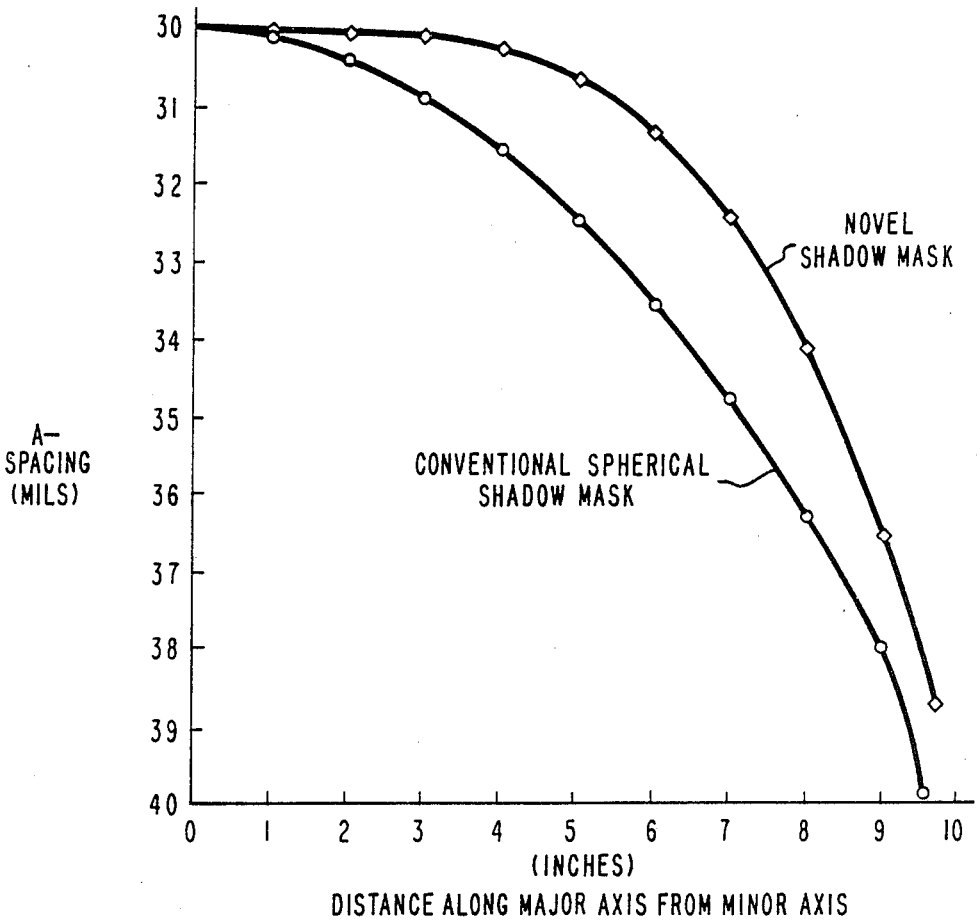
FIG. 8 is a graph showing aperture column-to-column spacing variations in a conventional spherical shadow mask and in a shadow mask according to the present invention.

FIG. 8 shows a graph of the actual a-spacings presented in Table II and in Table III, for visual comparison. The a-spacing of the conventional shadow mask begins increasing near the minor axis and continues increasing toward the edge of the mask in rather smooth fashion. However, the a-spacing of the novel shadow mask is relatively constant throughout the center portion of the mask and increases more rapidly approaching the sides of the mask.

The a-spacings of the novel mask at cross-sections parallel to, but off of, the major axis also vary approximately with the fourth power of distance from the minor axis, although in a slightly different manner. Table IV shows data, comparable to that of Table II, for a cross-section of the novel shadow mask near the border of the apertured pattern Y=7 inches) which parallels the major axis. For cross-sections between the major axis and the Y=7 inch parallel cross-section, the coefficients of $X^4$ lie between 0.001 and 0.00126.

TABLE IV

| (Inches) X | (Inches)$^4$ $X^4$ | (Mils) $30 + .00126X^4$ |
|---|---|---|
| 0 | 0 | 30.0 |

TABLE IV-continued

| (Inches) X | (Inches)$^4$ $X^4$ | (Mils) $30 + .00126X^4$ |
|---|---|---|
| 1 | 1 | 30.0 |
| 2 | 16 | 30.0 |
| 3 | 81 | 30.1 |
| 4 | 256 | 30.3 |
| 5 | 625 | 30.8 |
| 6 | 1296 | 31.6 |
| 7 | 2401 | 33.0 |
| 8 | 4096 | 35.2 |
| 9 | 6561 | 38.3 |
| 9.78 | 8744 | 41.0 |

What is claimed is:

1. In a color picture tube including a shadow mask mounted adjacent a cathodoluminescent line screen, said shadow mask including a major axis and a minor axis that is orthogonal to the major axis, said shadow mask including a plurality of slit-shaped apertures therein located in columns, said columns extending in the direction of the minor axis and being spaced from each other in the direction of the major axis, the improvement comprising the spacing along the major axis between adjacent aperture columns in the direction of the major axis increasing from center-to-edge of said shadow mask as approximately the fourth power of the distance along the major axis from the center of said shadow mask.

2. The tube as defined in claim 1, wherein the contour of said mask along its major axis varies approximately as a function of the fourth power of the distance from the center of said shadow mask.

3. In a color picture tube including a shadow mask mounted adjacent a cathodoluminescent line screen, said shadow mask including a major axis and a minor axis that is orthogonal to the major axis, said shadow mask including a plurality of slit-shaped apertures therein located in columns, said columns extending in the direction of the minor axis and being spaced from each other in the direction of the major axis, the improvement comprising the spacing along the major axis between adjacent aperture columns in the direction of the major axis varying from center-to-edge of said shadow mask approximately as a function of the fourth power of the distance from the center of said shadow mask, said function being a coefficient times the fourth power of distance and said coefficient being larger for cross-sections of the mask that are parallel to but off of a major axis of the mask than on the major axis.

4. In a color picture tube including a shadow mask mounted adjacent a cathodoluminescent line screen, said shadow mask including a major axis and a minor axis that is orthogonal to the major axis, said shadow mask including a plurality of slit-shaped apertures therein located in columns, the improvement comprising the contour of said mask along its major axis, from center-to-edge of said shadow mask, varying approximately as a function of the fourth power of distance from the center of said mask.

* * * * *